United States Patent [19]

Finger

[11] Patent Number: 4,663,872

[45] Date of Patent: May 12, 1987

[54] SIGN APPARATUS WITH MOVABLE SLEEVE

[75] Inventor: Otto R. Finger, Fox Point, Wis.

[73] Assignee: DCI Marketing, Milwaukee, Wis.

[21] Appl. No.: 692,395

[22] Filed: Jan. 18, 1985

[51] Int. Cl.[4] ..... G09F 7/00

[52] U.S. Cl. ..... 40/488; 40/19; 40/10 R

[58] Field of Search ..... 40/19, 488, 486, 487, 40/490, 442, 10, 584

[56] References Cited

U.S. PATENT DOCUMENTS

| | | | |
|---|---|---|---|
| 3,769,727 | 11/1973 | Kent | 40/488 |
| 4,177,593 | 12/1979 | Lockey | 40/488 |
| 4,217,713 | 8/1980 | Greenberger | 40/488 |

FOREIGN PATENT DOCUMENTS

| | | |
|---|---|---|
| 645202 | 9/1984 | Switzerland . |
| 206913 | 11/1923 | United Kingdom . |

*Primary Examiner*—Robert Peshock
*Assistant Examiner*—Wenceslao J. Contreras
*Attorney, Agent, or Firm*—Michael, Best & Friedrich

[57] ABSTRACT

A sign apparatus comprising a base member having first and second opposite ends and a longitudinal axis, the base member including a display surface adapted to have indicia thereon and having first and second portions adjacent the first and second ends, respectively, and a sleeve member slidably mounted on the base member for movement along the longitudinal axis, the sleeve member having a length such that the sleeve member alternatively covers the first and second portions of the display surface.

4 Claims, 7 Drawing Figures

SIGN APPARATUS WITH MOVABLE SLEEVE

BACKGROUND OF THE INVENTION

The invention relates to sign apparatus and, more particularly, to sign apparatus with changeable messages.

SUMMARY OF THE INVENTION

The invention provides a sign apparatus comprising an elongated base member, and a sleeve member slidably mounted on the base member for movement along the longitudinal axis of the base member, the sleeve member having a length approximately equal to one-half the length of the base member.

In the preferred embodiment, the base member has a triangular cross-section and includes three parallel display surfaces integrally connected at their edges. Each of the display surfaces has a first half or portion adjacent one end of the base member, and a second half or portion adjacent the opposite end of the base member. Each half of each of the display surfaces is adapted to have a message or indicia thereon.

The sleeve member preferably also has a triangular cross-section and surrounds the base member in telescoping relationship. The sleeve member includes three generally planar portions associated with the three display surfaces of the base member, and each of the sleeve portions can also have a message thereon, if desired. When the sleeve member is moved to the one end of the base member, the sleeve member covers the first half of each of the display surfaces of the base member and exposes the second half of each of the display surfaces. Alternatively, when the sleeve member is moved to the opposite end of the base member, the sleeve member covers the second half of each of the display surfaces of the base member and exposes the first half of each of the display surfaces.

The display surfaces of the base member are adapted to have thereon messages such as the words "open" or "closed". It is readily apparent that the sign apparatus can display six different messages depending on which of the three display surfaces is facing the viewer and which half of that display surface is exposed by the sleeve member.

The sign apparatus can be used, for example, to indicate whether a check-out aisle in a grocery store is open or closed. One half of one of the display surfaces would have the word "open" displayed thereon, and the other half of the display surface would have the word "closed" displayed thereon. The status of the check-out aisle would be indicated by moving the sleeve member to expose the appropriate word.

Of course, the open/closed arrangement can be used in other situations. Furthermore, the other display surfaces can display other messages.

Preferably, the base member also includes stop means for preventing the sleeve member from sliding off the ends of the base member. In the preferred embodiment, the stop means includes end members integrally attached to the opposite ends of the base member and having portions extending outwardly of each of the display surfaces.

Various other features and advantages of the invention will become apparent to those skilled in the art upon review of the following detailed description, claims, and drawings.

Figure 1:
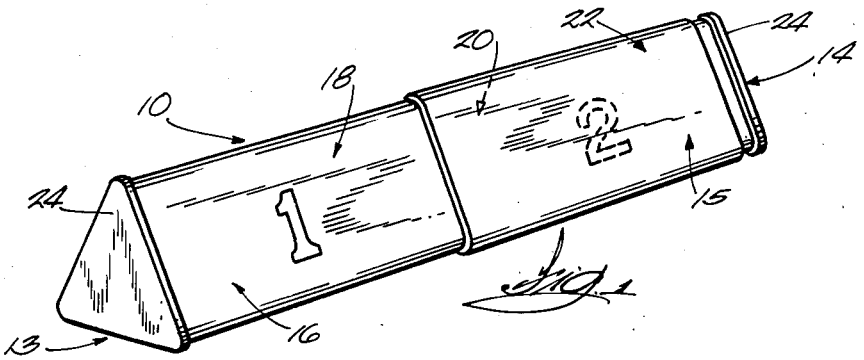
FIG. 1 is a perspective view of a sign apparatus embodying the invention.
Figure 3:
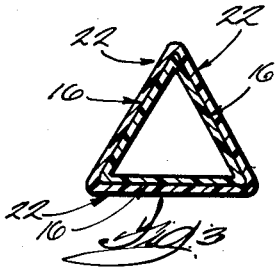
FIG. 3 is a cross-sectional view taken along line 3—3 in FIG. 2.
Figure 2:
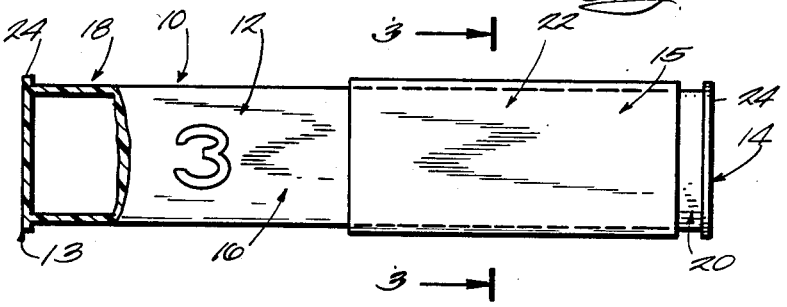
FIG. 2 is a side elevation view of the apparatus with portions cut away.
Figure 5:
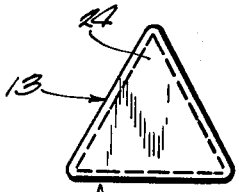
FIG. 5 is an end view of the sign apparatus shown in FIGS. 1–4.
Figure 4:
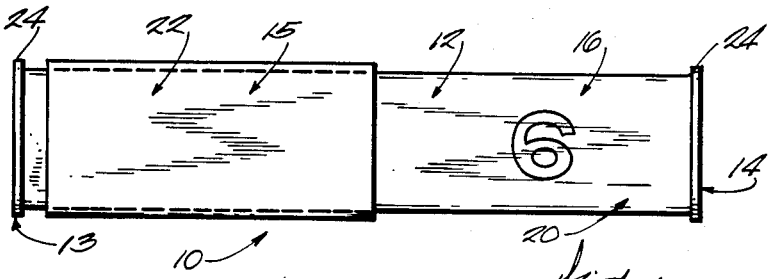
FIG. 4 is a side elevation view of the side opposite the side shown in FIG. 2.

Before explaining one embodiment of the invention in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A sign apparatus 10 embodying the invention is illustrated in the drawings. In the preferred embodiment, as illustrated in FIGS. 1 through 5, the apparatus 10 comprises a base member 12 having opposite ends 13 and 14 and a longitudinal axis, and a sleeve member 15 slidably mounted on and surrounding the base member 12 in telescoping relationship for movement along the longitudinal axis of the base member 12.

The base member 12 has a triangular cross-section and includes three generally parallel display surfaces 16 integrally connected to each other at their lateral edges. Each of the display surfaces 16 has a first portion or half 18 adjacent the end 13 of the base member 12, and a second portion or half 20 adjacent the opposite end 14 of the base member 12. Each half of each of the display surfaces 16 is adapted to have indicia or a message thereon.

The sleeve member 15 also has a triangular cross-section and includes three generally planar, integral portions 22 associated with the three display surfaces 16 of the base member 12. Each of the sleeve portions 22 can also have a message thereon. The sleeve member 15 has a length approximately equal to one half the length of the base member 12 such that the sleeve member 15 alternatively covers either the first halves 18 or the second halves 20 of the display surfaces 16.

In the preferred embodiment, the base member 12 further includes first stop means for preventing the sleeve member 15 from sliding off the end 13 of the base member 12, and second stop means for preventing the sleeve member 15 from sliding off the opposite end 14 of the base member 12. While various suitable stop means can be employed, in the illustrated construction, both the first and second stop means include an end member 24 integrally attached to the end of the base member 12 and having portions extending outwardly of each of the display surfaces 16.

Figure 6:
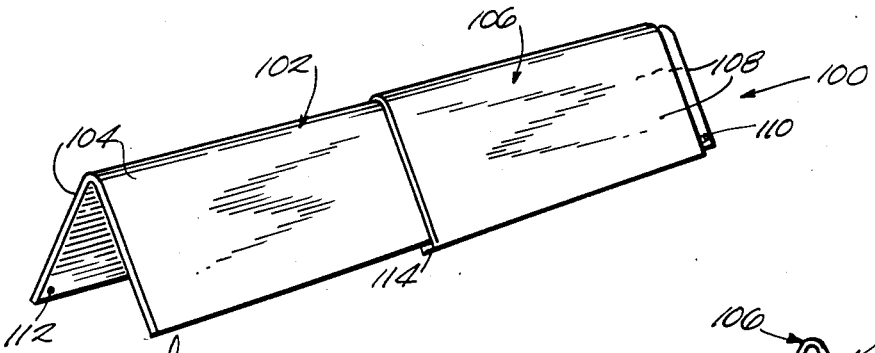
FIG. 6 is a perspective view of an alternative embodiment of the invention.
Figure 7:
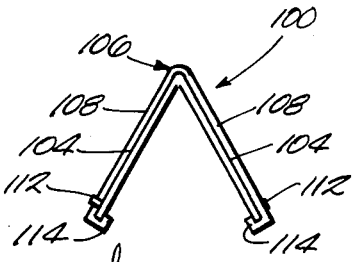
FIG. 7 is an end view of the apparatus shown in FIG. 6.

An apparatus 100 which is an alternative embodiment of the invention is illustrated in FIGS. 6 and 7. In the alternative embodiment, the apparatus 100 includes a base member 102 having a cross-section in the shape of an inverted V, the base member 102 including two generally parallel display surfaces 104 integrally connected at their upper edges. The apparatus 100 also includes a sleeve member 106 having a cross-section in the shape of an inverted V and being slidably mounted on the base member 102 for movement along the longitudinal axis of the base member 102. The sleeve member 106 has two generally planar portions 108 associated with the display surfaces 104 of the base member 102. As in the preferred embodiment, the sleeve member 106 has a length approximately equal to one half the length of the base member 102.

In the alternative embodiment, the base member 102 also includes stop means for preventing the sleeve member from sliding off the opposite ends of the base member 102. In this construction, the stop means includes a first pin 110 extending outwardly from one of the display surfaces 106 adjacent one end of the base member 102, and a second pin 112 extending outwardly from the opposite display surface 106 adjacent the opposite end of the base member 102.

In the alternative embodiment, the sleeve member 106 includes means for retaining the sleeve member 106 on the base member 102. While various suitable retaining means can be used, in the illustrated construction, the retaining means includes a lip 114 on the lower edge of each of the planar portions 108 of the sleeve member 106 overlapping the lower edges of the associated display surfaces 104.

Various other features of the invention are set forth in the following claims.

I claim:

1. A sign apparatus comprising a base member having first and second opposite ends, a longitudinal axis, and a triangular cross section, said base member including first, second, and third display surfaces adapted to have indicia thereon and each having first and second portions adjacent said first and second ends, respectively, and a sleeve member having a triangular cross section and being slidably mounted on and surrounding said base member in telescoping relationship for movement along said longitudinal axis, said sleeve member having first, second, and third portions associated with said first, second, and third display surfaces, respectively, and said sleeve member having a length approximately equal to one half of said length of said base member such that said sleeve member alternatively covers said first portions and said second portions of said first, second, and third display surfaces.

2. A sign apparatus as set forth in claim 1 wherein said base member further includes first stop means for preventing said sleeve member from sliding off said first end of said base member, and second stop means for preventing said sleeve member from sliding off said second end of said base member.

3. A sign apparatus as set forth in claim 2 wherein said first stop means includes a pin extending outwardly from one of said first, second, and third display surfaces adjacent said first end, and wherein said second stop means includes a pin extending outwardly from one of said first, second, and third display surfaces adjacent said second end.

4. A sign apparatus as set forth in claim 2 wherein said first stop means includes a first end member integrally attached to said first end of said base member and having portions extending outwardly of each of said first, second, and third display surfaces, and wherein said second stop means includes a second end member integrally attached to said second end of said base member and having portions extending outwardly of each of said first, second, and third display surfaces.

* * * * *